US008688006B2

(12) United States Patent
Kobayashi et al.

(10) Patent No.: US 8,688,006 B2
(45) Date of Patent: Apr. 1, 2014

(54) DRIVE TRANSMISSION DEVICE INCLUDING A DETECTION DEVICE AND A PROTECTION MEMBER MADE OF A CONDUCTIVE MATERIAL

(75) Inventors: Kazuhiro Kobayashi, Kanagawa (JP); Toshiyuki Uchida, Kanagawa (JP); Narumi Sugita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 271 days.

(21) Appl. No.: 13/067,941

(22) Filed: Jul. 8, 2011

(65) Prior Publication Data

US 2012/0027464 A1 Feb. 2, 2012

(30) Foreign Application Priority Data

Jul. 30, 2010 (JP) ..... 2010-172947

(51) Int. Cl.
*G03G 15/00* (2006.01)

(52) U.S. Cl.
USPC ..... 399/167

(58) Field of Classification Search
USPC ..... 399/167
See application file for complete search history.

(56) References Cited

U.S. PATENT DOCUMENTS

| | | | | |
|---|---|---|---|---|
| 5,799,229 | A | 8/1998 | Yokoyama et al. | |
| 5,878,317 | A | 3/1999 | Masuda et al. | |
| 5,946,529 | A | 8/1999 | Sato et al. | |
| 5,956,556 | A * | 9/1999 | Nakajima et al. | 399/359 |
| 6,725,991 | B2 | 4/2004 | Murano et al. | |
| 6,779,975 | B2 | 8/2004 | Takashima et al. | |
| 7,206,537 | B2 | 4/2007 | Funamoto et al. | |
| 7,215,907 | B2 | 5/2007 | Fukuchi et al. | |
| 7,352,978 | B2 | 4/2008 | Ebara et al. | |
| 7,369,795 | B2 | 5/2008 | Funamoto et al. | |
| 7,376,376 | B2 | 5/2008 | Ebara et al. | |
| 7,532,842 | B2 | 5/2009 | Handa et al. | |
| 7,603,061 | B2 | 10/2009 | Ebara et al. | |
| 7,630,657 | B2 | 12/2009 | Ehara et al. | |
| 7,653,332 | B2 | 1/2010 | Ehara et al. | |
| 7,693,468 | B2 | 4/2010 | Ehara et al. | |
| 7,693,480 | B2 | 4/2010 | Nomura et al. | |
| 7,697,867 | B2 | 4/2010 | Ehara et al. | |
| 7,726,648 | B2 | 6/2010 | Tamura et al. | |

(Continued)

FOREIGN PATENT DOCUMENTS

| | | | |
|---|---|---|---|
| JP | 59171981 A | * | 9/1984 |
| JP | 11065355 A | * | 3/1999 |

(Continued)

*Primary Examiner* — Quana M Grainger
(74) *Attorney, Agent, or Firm* — Harness, Dickey & Pierce, P.L.C.

(57) ABSTRACT

A drive transmission device includes drive transmission members including a detection target gear, a detection device detecting the rotational position of the target gear and including a position detection member and a detection unit, and a conductive protection member protecting the detection unit. The detection unit and the protection member are assembled to the same member to be installed to an external apparatus. If there is a dimensional error in the protection member causing a portion of the protection member closest to the target gear to shift in position relative to the detection unit beyond a predetermined range, the protection member comes into contact with the detection unit in the assembling process, and is corrected in shape by the detection unit, with the shift in position relative to the detection unit of the portion of the protection member closest to the target gear kept within the predetermined range.

20 Claims, 9 Drawing Sheets

(56) References Cited

U.S. PATENT DOCUMENTS

| | | | | |
|---|---|---|---|---|
| 7,729,024 | B2 | 6/2010 | Kobayashi et al. | |
| 7,773,914 | B2 | 8/2010 | Funamoto et al. | |
| 7,796,929 | B2 | 9/2010 | Ebara et al. | |
| 7,802,789 | B2 | 9/2010 | Tokita et al. | |
| 7,937,007 | B2 | 5/2011 | Kobayashi et al. | |
| 8,254,813 | B2 * | 8/2012 | Funamoto et al. | 399/167 |
| 2003/0047407 | A1 | 3/2003 | Murano et al. | |
| 2003/0053908 | A1 | 3/2003 | Takashima et al. | |
| 2004/0081225 | A1 * | 4/2004 | Janicek | 374/185 |
| 2005/0058470 | A1 | 3/2005 | Funamoto et al. | |
| 2005/0084293 | A1 | 4/2005 | Fukuchi et al. | |
| 2006/0056868 | A1 | 3/2006 | Ebara et al. | |
| 2006/0182465 | A1 | 8/2006 | Funamoto et al. | |
| 2006/0222418 | A1 | 10/2006 | Ebara et al. | |
| 2006/0261544 | A1 | 11/2006 | Tamura et al. | |
| 2007/0051219 | A1 | 3/2007 | Tamura et al. | |
| 2007/0097465 | A1 | 5/2007 | Kobayashi et al. | |
| 2007/0110477 | A1 | 5/2007 | Handa et al. | |
| 2007/0147925 | A1 | 6/2007 | Nomura et al. | |
| 2007/0166075 | A1 | 7/2007 | Funamoto et al. | |
| 2007/0196132 | A1 | 8/2007 | Kobayashi et al. | |
| 2007/0212109 | A1 | 9/2007 | Ebara et al. | |
| 2007/0253736 | A1 | 11/2007 | Ehara et al. | |
| 2007/0258729 | A1 | 11/2007 | Ehara et al. | |
| 2007/0274746 | A1 | 11/2007 | Ehara et al. | |
| 2008/0069604 | A1 | 3/2008 | Ebara et al. | |
| 2008/0131168 | A1 | 6/2008 | Ehara et al. | |
| 2008/0166153 | A1 | 7/2008 | Ehara et al. | |
| 2008/0213000 | A1 | 9/2008 | Funamoto et al. | |
| 2008/0240754 | A1 | 10/2008 | Kobayashi et al. | |
| 2009/0074506 | A1 | 3/2009 | Sugiyama et al. | |
| 2009/0206547 | A1 | 8/2009 | Tokita et al. | |
| 2010/0266299 | A1 | 10/2010 | Funamoto et al. | |
| 2010/0310281 | A1 | 12/2010 | Miura et al. | |

FOREIGN PATENT DOCUMENTS

| | | | |
|---|---|---|---|
| JP | 2000223555 | A | 8/2000 |
| JP | 2004246323 | A | 9/2004 |
| JP | 2007226206 | A | 9/2007 |
| JP | 2009153350 | A | 7/2009 |

* cited by examiner

DRIVE TRANSMISSION DEVICE INCLUDING A DETECTION DEVICE AND A PROTECTION MEMBER MADE OF A CONDUCTIVE MATERIAL

CROSS-REFERENCE TO RELATED APPLICATIONS

The patent application is based on and claims priority pursuant to 35 U.S.C. §119 from Japanese Patent Application No. 2010-172947, filed on Jul. 30, 2010 in the Japan Patent Office, the entire disclosure of which is hereby incorporated herein by reference.

BACKGROUND OF THE INVENTION

1. Field of the Invention

Embodiments of the present invention relate to a drive transmission device including drive transmission members that transmit drive from a drive source to a driven object, and all or a part of which forms a gear train, and to a drive device and an image forming apparatus including the drive transmission device.

2. Description of the Related Art

A background image forming apparatus is known that includes a plurality of image forming units that form toner images of a plurality of colors including black on image carrying members corresponding to the respective colors.

In this type of image forming apparatus, the toner images formed on the image carrying members corresponding to the respective colors are superimposed on one another on a recording medium to form a full-color image on the recording medium. To attain highly accurate color registration on the recording medium, therefore, it is desired to reduce superimposition deviation of the colors caused by, for example, variations in rotation cycle among the image carrying members. To match the rotational phases of the image carrying members corresponding to the respective colors and thereby reducing the superimposition deviation of the colors, the rotational positions of the image carrying members for the respective colors are detected, and the driving of drive sources for driving to rotate the image carrying members is controlled on the basis of the results of detection, thereby matching the phases of the respective colors.

As a configuration for detecting the rotational position of each of the image carrying members for the respective colors, a configuration has been proposed in which a position detection member for detecting the rotational position is provided to an image carrying member drive gear that is coaxially fixed to the image carrying member and receives rotational drive transmitted from the drive source, and which detects the position detection member by using a detection unit provided to the image forming apparatus.

In a drive transmission device including the image carrying member drive gear to transmit the rotational drive from the drive source to the image carrying member, however, the image carrying member drive gear is charged to a relatively high potential in some cases. This is because the image carrying member drive gear is frictionally charged by sliding friction occurring between the image carrying member drive gear and a drive transmission gear that meshes with the image carrying member drive gear to transmit the drive thereto. If the image carrying member drive gear is charged to a relatively high potential, dielectric breakdown may occur between the image carrying member drive gear and the detection unit disposed in the vicinity thereof and cause abnormal output from the detection unit. As a configuration for reducing the occurrence of dielectric breakdown, it is conceivable to provide a conductive member around the detection unit. However, if there is a large error in the installation position of the conductive member relative to the installation position of the detection unit disposed in the vicinity of the image carrying member drive gear, the conductive member may come into contact with and damage the image carrying member drive gear.

The above-described issue is not limited to the drive transmission device in which the image carrying member drive gear serves as the detection target gear, the rotational position of which is detected by the detection unit. The issue may also arise in a configuration that uses the detection unit to detect the rotational position of at least one of the gears forming a gear train.

SUMMARY OF THE INVENTION

The present invention describes a novel drive transmission device. In one example, a novel drive transmission device includes drive transmission members, a detection device, and a shape-variable protection member. The drive transmission members transmit drive from a drive source to a driven object, and at least a part of the drive transmission members is formed by a gear train including a detection target gear. The detection device detects the rotational position of the detection target gear, and includes a position detection member and a detection unit. The position detection member is provided to the detection target gear, and is configured to change in position in accordance with the change in rotational position of the detention target gear. The detection unit is disposed in the vicinity of the detection target gear, and is configured to detect the position detection member at a detection position. The shape-variable protection member is made of a conductive material minimizing the influence of electromagnetic waves on the detection unit. The detection unit and the protection member are assembled to the same member for installation to an external apparatus, such that, in a case in which there is a dimensional error in the protection member causing a portion of the protection member closest to the detection target gear to shift in position relative to the detection unit beyond a predetermined range, the protection member contacts the detection unit in the process of assembling the detection unit and the protection member, and is corrected in shape by the detection unit, with the shift in position relative to the detection unit of the portion of the protection member closest to the detection target gear kept within the predetermined range.

The protection member may be made of a sheet metal, and a part of the protection member may be electrically grounded.

The protection member may include a conductive tape covering the detection unit, and a part of the protection member may be electrically grounded.

The above-described drive transmission device may further include a charge prevention member provided in the vicinity of the detection target gear and to prevent an increase in charge potential of the detection target gear.

The charge prevention member may include a brush having a charge neutralization capability.

The charge prevention member may be provided in the vicinity of a gear teeth surface of the detection target gear.

The charge prevention member may be provided in the vicinity of a position passed by the position detection member provided to the detection target gear during the rotation of the detection target gear.

The position at which the charge prevention member is closest to the detection target gear may be in the vicinity of the detection position, and may be upstream from the detection position in the rotation direction of the detection target gear.

The position detection member may be disposed at a position closer to the center of rotation of the detection target gear than a position at which the surface potential of the charged detection target gear is half the surface potential of a gear teeth surface of the detection target gear.

The present invention further describes a novel drive device. In one example, the drive device includes a drive source to drive rotatably, and the above-described drive transmission device to transmit rotational drive of the drive source to the driven object.

The present invention further describes a novel image forming apparatus. In one example, the image forming apparatus includes an image forming unit to form an image on an image carrying member and eventually transfer the image onto a recording medium to form the image on the recording medium, and the above-described drive device to drive the driven object provided in the image forming apparatus.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
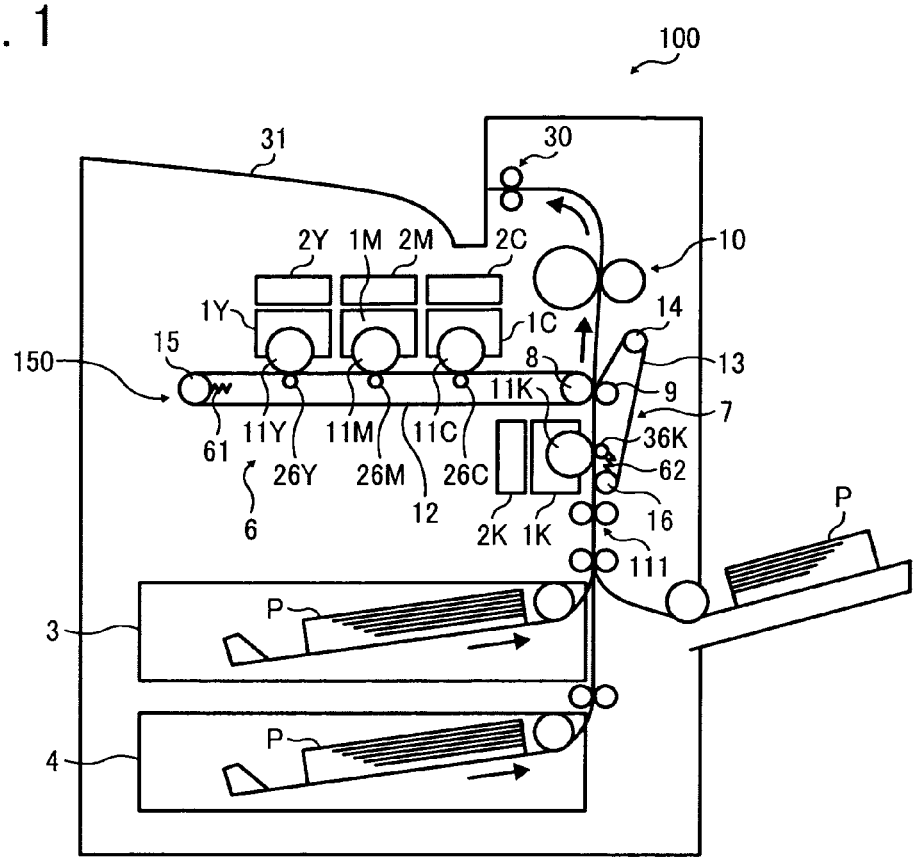
FIG. 1 is a schematic configuration diagram of a printer according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
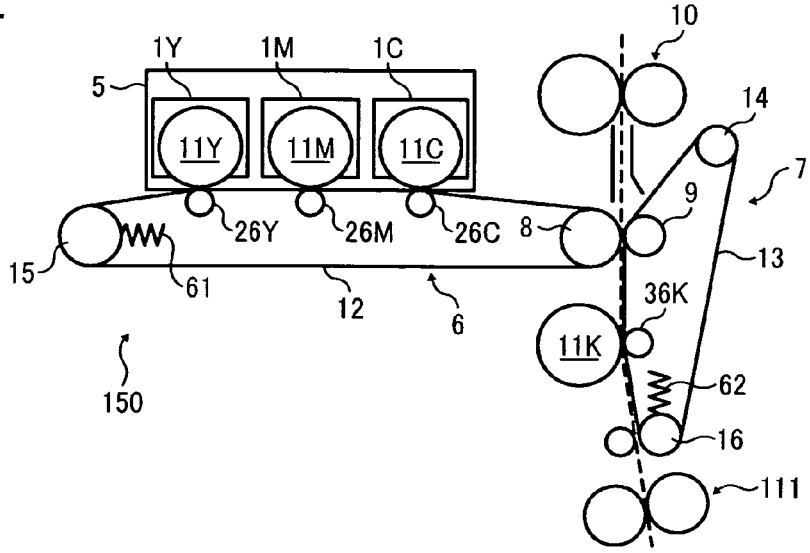
FIG. 2 is an explanatory enlarged view of a printer unit of the printer.

With reference to FIG. 1, a description is given of a basic configuration of an electrophotographic color laser printer (hereinafter simply referred to as the printer 100) as an image forming apparatus according to an embodiment of the present invention. FIG. 1 is a schematic configuration diagram illustrating the printer 100 serving as an image forming apparatus. As illustrated in FIG. 1, the printer 100 includes a printer unit 150. FIG. 2 is an explanatory enlarged view of the printer unit 150.

The printer unit 150 includes four image forming units 1Y, 1M, 1C, and 1K for forming toner images of yellow, magenta, cyan, and black (hereinafter, also referred to as Y, M, C, and K, respectively) colors.

Further, as illustrated in FIGS. 1 and 2, the printer unit 150 includes an intermediate transfer unit 6. The intermediate transfer unit 6 includes an intermediate transfer belt 12 and rollers provided inside the loop of the intermediate transfer belt 12, i.e., an intermediate transfer belt drive roller 8, an intermediate transfer belt tension roller 15, and three primary transfer rollers 26Y, 26M, and 26C. The intermediate transfer belt 12 is stretched by the intermediate transfer belt drive roller 8, the intermediate transfer belt tension roller 15, and the primary transfer rollers 26Y, 26M, and 26C to extend in the horizontal direction. The intermediate transfer belt tension roller 15 is pivotally and swingably supported, and is biased by an intermediate transfer spring 61 from the inside to the outside of the intermediate transfer belt 12 to apply tension to the intermediate transfer belt 12. The intermediate transfer belt 12 serving as an image carrying member is rotated in the counterclockwise direction in the drawings as the intermediate transfer belt drive roller 8 is driven to rotate. The three image forming units 1Y, 1M, and 1C are arranged in a line along the stretched surface of the intermediate transfer belt 12.

Each of the image forming units 1Y, 1M, 1C, and 1K is formed as one unit containing the corresponding one of photoconductor drums 11Y, 11M, 11C, and 11K (hereinafter occasionally referred to as the photoconductor drums 11), a charging device, a development device, and a drum cleaning device, and is held by a holding member common to the image forming units 1Y, 1M, 1C, and 1K. The charging device uniformly charges, in the dark, the circumferential surface of the photoconductor drum 11Y, 11M, 11C, or 11K, which is driven to rotate by a drive device, to a polarity opposite to the charge polarity of the toner. Further, as illustrated in FIG. 2, the image forming units 1Y, 1M, and 1C are integrated together as an image forming unit 5, and are removably installable in the printer 100 as the image forming unit 5. Further, each of the image forming units 1Y, 1M, and 1C is removably installable in the image forming unit 5 that is removed from the printer 100.

In FIG. 1, optical writing units 2Y, 2M, and 2C are provided above the image forming units 1Y, 1M, and 1C for forming color images, and an optical writing unit 2K is provided on the left side of the image forming unit 1K for the K color. Color image information transmitted from an external device, such as a personal computer, is separated into respective information items for the Y, M, C, and K colors in an image processing unit. Thereafter, the information items are processed in the printer unit 150. Based on the color-separated image information of the Y, M, C, and K colors, the optical writing units 2Y, 2M, 2C, and 2K drive light sources for the Y, M, C, and K colors in accordance with a commonly known technique, and generate writing lights for the Y, M, C, and K colors. Then, the circumferential surfaces of the photoconductor drums 11Y, 11M, 11C, and 11K uniformly charged by the respective charging devices are scanned with the writing lights for the Y, M, C, and K colors. Thereby, electrostatic latent images for the Y, M, C, and K colors are formed on the circumferential surfaces of the photoconductor drums 11Y, 11M, 11C, and 11K, respectively. Light sources of the writing lights may include, for example, laser diodes or LEDs (Light-Emitting Diodes).

The electrostatic latent images formed on the circumferential surfaces of the photoconductor drums 11Y, 11M, 11C, and 11K are developed into toner images of the Y, M, C, and K colors by the respective development devices according to a commonly known two-component development method using a two-component developer containing toner and carrier. Alternatively, the development devices may employ a commonly known one-component development method using a one-component developer containing toner.

Among the four photoconductor drums 11, the photoconductor drums 11Y, 11M, and 11C for color images contact with the intermediate transfer belt 12 to form primary transfer nip areas for the Y, M, and C colors. Further, inside the loop of the intermediate transfer belt 12, the primary transfer rollers 26Y, 26M, and 26C are disposed to press the intermediate transfer belt 12 against the photoconductor drums 11Y, 11M, and 11C, respectively. The primary transfer rollers 26Y, 26M, and 26C are applied with a primary transfer bias voltage. Thereby, a transfer electric field is generated in each of the primary transfer nip areas for the Y, M, and C colors. With the action of the transfer electric field and nip pressure, the toner images of the Y, M, and C colors formed on the circumferential surfaces of the photoconductor drums 11Y, 11M, and 11C are transferred in a superimposed manner onto a front surface of the intermediate transfer belt 12, i.e., the outer surface of the loop of the intermediate transfer belt 12, at the primary transfer nips for the Y, M, and C colors. Thereby, the superimposed images of the three colors are formed on the front surface of the intermediate transfer belt 12.

On the right side of the intermediate transfer belt 12 in FIGS. 1 and 2, a recording medium transfer unit 7 is provided that transfers the toner images on the image carrying members onto a recording sheet P serving as a recording medium. The recording medium transfer unit 7 includes a loop-shaped recording medium transfer belt 13. The recording medium transfer belt 13 is stretched by a secondary transfer roller 9, a recording medium transfer belt drive roller 14, a recording medium transfer belt tension roller 16, and a transfer roller 36K for the K color to extend in a substantially vertical direction. Further, the recording medium transfer belt 13 is rotated in the clockwise direction in the drawings as the recording medium transfer belt drive roller 14 is driven to rotate. The recording medium transfer belt tension roller 16 is pivotally and swingably supported, and is biased by a recording medium transfer spring 62 from the inside to the outside of the recording medium transfer belt 13 to apply tension to the recording medium transfer belt 13. Further, a portion of the recording medium transfer belt 13 passing over the secondary transfer roller 9 contacts a portion of the intermediate transfer belt 12 passing over the intermediate transfer belt drive roller 8 to form a secondary transfer nip area. The secondary transfer roller 9 is applied with a secondary transfer bias voltage so that a transfer electric field can be generated in the secondary transfer nip area. Further, a portion of the recording medium transfer belt 13 passing over the transfer roller 36K for the K color contacts the photoconductor drum 11K for the K color to form a direct transfer nip area for the K color. The transfer roller 36K is applied with a transfer bias voltage, similarly as in the primary transfer rollers 26Y, 26M, and 26C, so that a transfer electric field can be generated in the direct transfer nip area for the K color.

Below the printer unit 150 in the printer 100, a first sheet feeding cassette 3 and a second sheet feeding cassette 4 are provided one above the other in the vertical direction. A recording sheet P is stored in and fed from one of the first and second sheet feeding cassettes 3 and 4 to a sheet conveyance path. Alternatively, the recording sheet P may be fed from a manual sheet feeding tray provided on the right side in FIG. 1.

The recording sheet P fed as described above abuts against a pair of registration rollers 111 provided at the sheet conveyance path extending in the substantially vertical direction in the printer 100 so as to correct the skew of the recording sheet P. Thereafter, the recording sheet P is held between the pair of registration rollers 111, and is conveyed further upward by the pair of registration rollers 111 at a predetermined time.

The recording sheet P conveyed by the pair of registration rollers 111 sequentially passes the above-described direct transfer nip area for the K color and the secondary transfer nip for the Y, M, and C colors, which are formed along the sheet conveyance path. When the recording sheet P passes the direct transfer nip area for the K color, the toner image of the K color formed on the circumferential surface of the photoconductor drum 11K is transferred onto the recording sheet P with the action of the transfer electric field and nip pressure. Thereafter, when the recording sheet P passes the secondary transfer nip area, the superimposed toner images of the three colors of Y, M, and C are secondarily transferred at one time onto the toner image of the K color, which has been transferred to the recording sheet P, with the action of the transfer electric field and nip pressure. Consequently, a full-color image combining the superimposed toner images of the four colors of Y, M, C, and K is formed on a surface of the recording sheet P.

Residual toner remaining on the circumferential surfaces of the photoconductor drums 11Y, 11M, and 11C after the photoconductor drums 11Y, 11M, and 11C have passed the primary transfer nip areas for the Y, M, and C colors and residual toner remaining on the circumferential surface of the photoconductor drum 11K after the photoconductor drum 11K has passed the direct transfer nip area for the K color are removed by the respective drum cleaning devices described above. The drum cleaning devices for the Y, M, C, and K colors may employ, for example, a method of scraping off the toner by using a cleaning blade or a fur brush or a magnetic brush cleaning method.

Above the secondary transfer nip area, a fixing device 10 is provided in which a heating roller and a pressure roller contact with each other to form a fixing nip area. The recording sheet P having passed through the secondary transfer nip area is conveyed to the fixing nip in the fixing device 10, and is subjected to a fixing process for fixing the full-color image to the recording sheet P by application of heat and pressure. The positional relationship between the secondary transfer nip area and the fixing nip area of the fixing device 10 is set such that the recording sheet P is conveyed straight from the secondary transfer nip area to the fixing device 10. Thereafter, the recording sheet P is conveyed through a sheet discharging path, passes a sheet discharging roller pair 30, and is discharged and stacked on a sheet discharging tray 31 provided on the upper surface of the housing of the printer 100.

In a monochrome printing mode of the printer 100 for forming a monochrome image, the photoconductor drum 11K for the K color is optically scanned by the optical writing unit 2K based on monochrome image data that is transmitted from the external device, such as a personal computer. By so doing, the electrostatic latent image for the K color formed on the circumferential surface of the photoconductor drum 11K is developed into the toner image of the K color by the development device for the K color. The toner image of the K color is directly transferred onto the recording sheet P at the direct transfer nip area for the K color, and thereafter is fixed to the recording sheet P by the fixing device 10.

The monochrome image is formed with the driving of the image forming units 1Y, 1M, and 1C for color images and the intermediate transfer belt 12 stopped. Therefore, the image forming units 1Y, 1M, and 1C for color images, which include the photoconductor drums 11Y, 11M, and 11C for color images, and the intermediate transfer belt 12 are prevented from being unnecessarily driven and worn, and thus have an extended service life.

In the monochrome printing mode, the toner image of the K color is directly transferred from the image forming unit 1K for the K color onto the recording sheet P conveyed by the pair of registration rollers 111 and sent into the direct transfer nip area for the K color by the recording medium transfer belt 13. Therefore, the present configuration attains high-speed printing of the monochrome image than in a configuration in which the image forming unit 1K in addition to the image forming units 1Y, 1M, and 1C are arranged in a line along the stretched surface of the intermediate transfer belt 12 to transfer the toner image of the K color onto the recording sheet P at the secondary transfer nip area via the intermediate transfer belt 12.

Next, a description will be given of drive devices that drive to rotate the photoconductor drums 11.

The four photoconductor drums 11 are driven to rotate by the drives transmitted from separate drive sources.

Figure 3A:
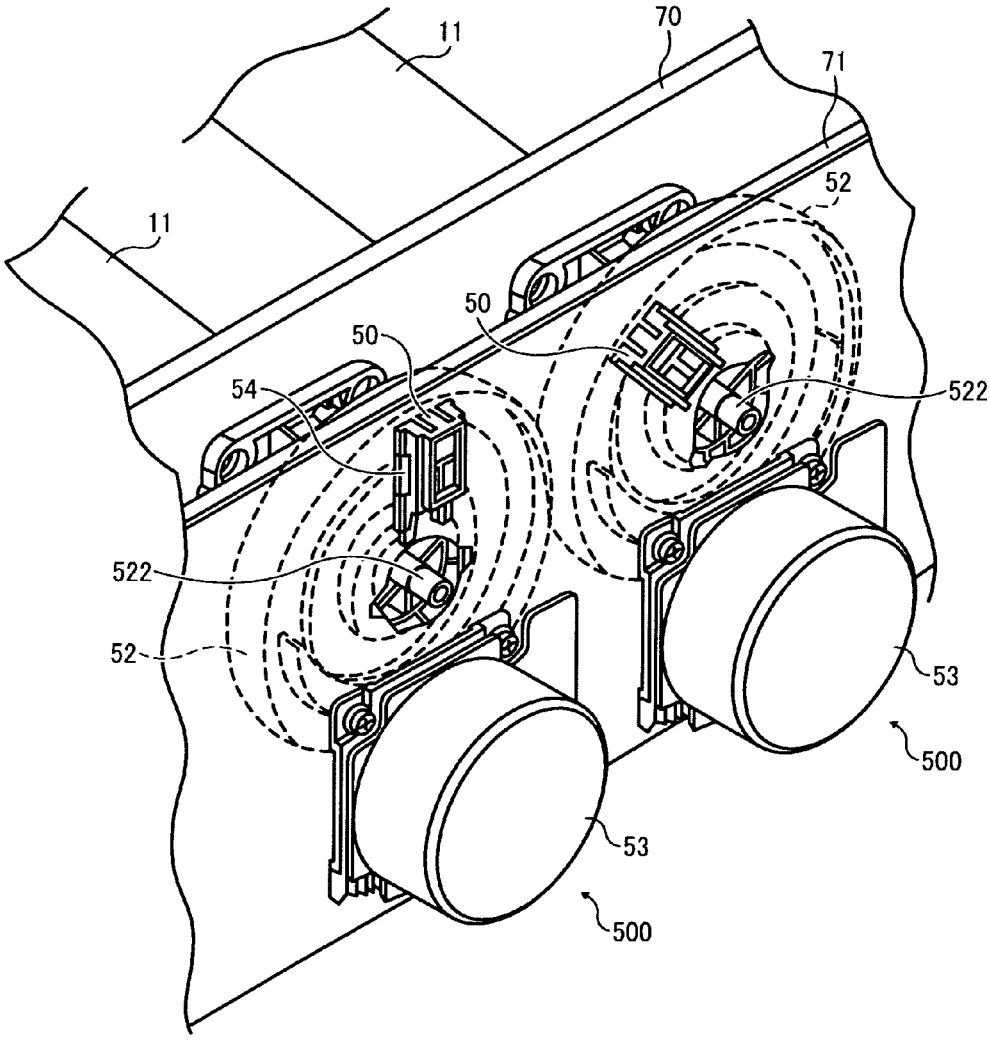
FIGS. 3A and 3B are explanatory perspective views of two drive devices according to an embodiment of the present invention, FIG. 3A illustrating a side wall plate and a bracket, and FIG. 3B illustrating the components of FIG. 3A with the side wall plate, the bracket, and photoconductor drums omitted therefrom.
Figure 3B:
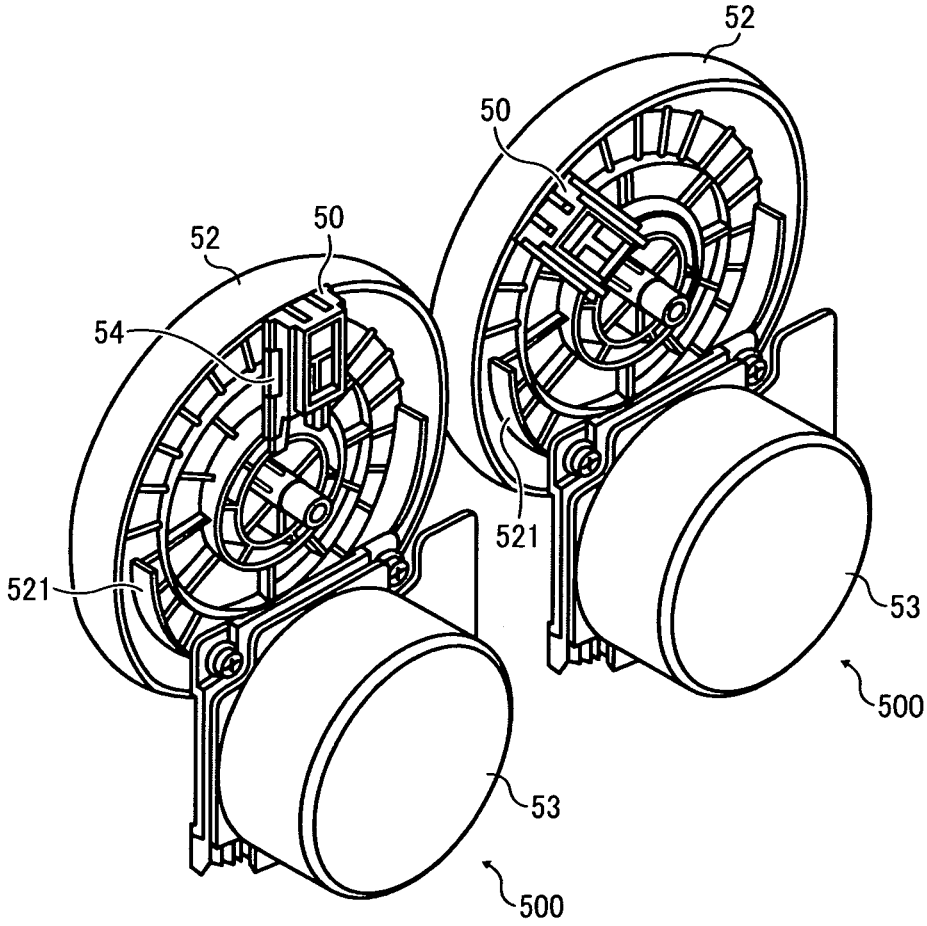

FIGS. 3A and 3B are explanatory perspective views of drive devices 500 for two photoconductor drums 11 selected from the photoconductor drums 11Y, 11M, and 11C for color images. FIG. 3A is a diagram illustrating a side wall plate 70 and a bracket 71. The side wall plate 70 forms the housing of the printer 100, and is located on the far side in FIG. 1. The bracket 71 positions components of the drive devices 500 with respect to the side wall plate 70. FIG. 3B is a diagram illustrating the components of FIG. 3A, with the side wall plate 70, the bracket 71, and the photoconductor drums 11 omitted therefrom.

In FIGS. 3A and 3B, each of the drive devices 500 includes a sensor unit 50 including a sensor cover 54, a photoconductor drive gear 52 provided with a feeler 521 and a rotary shaft 522, and a drive motor 53.

Figure 4:
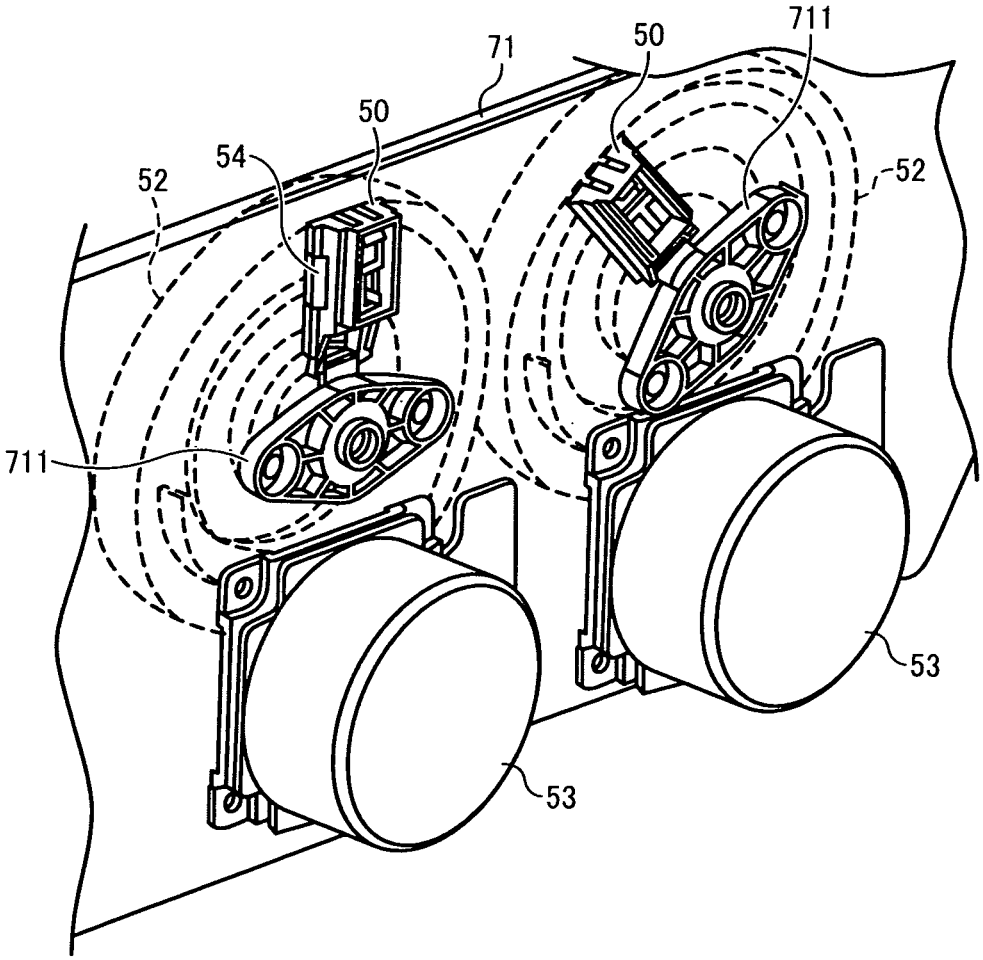
FIG. 4 is an explanatory perspective view of components including the bracket attached with shaft bearings.

FIG. 4 is an explanatory perspective view of components including the bracket 71 attached with shaft bearings 711. Each of the shaft bearings 711 fits on the rotary shaft 522 of the corresponding photoconductor drive gear 52 to be fixed to the bracket 71. By so doing, the photoconductor drive gear 52 is rotatably supported with respect to the bracket 71.

Figure 5:
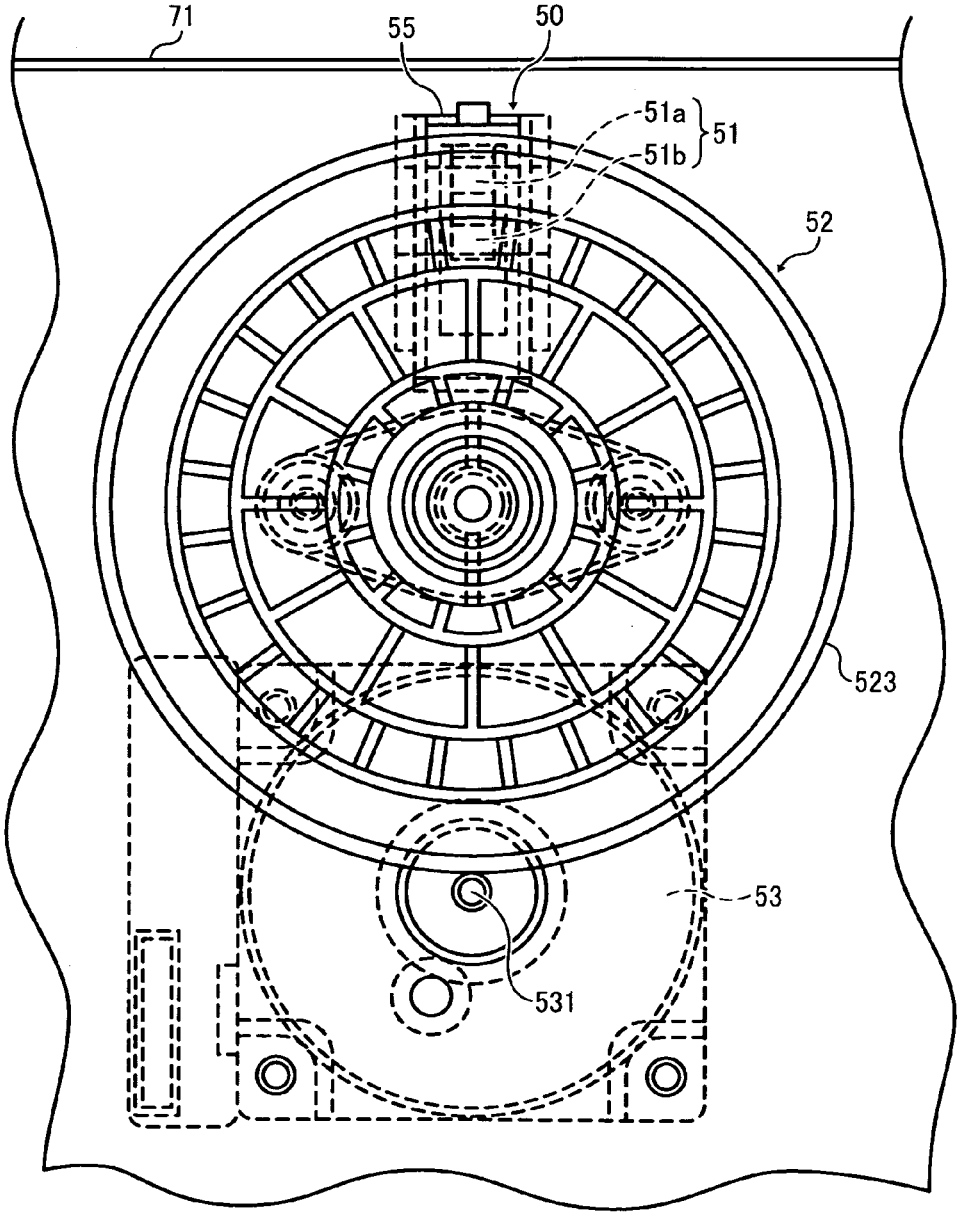
FIG. 5 is an explanatory view of a photoconductor drive gear and the bracket, as viewed from the side of the side wall plate.

FIG. 5 is an explanatory view of the drive device 500 for a single photoconductor drum 11, illustrating the photoconductor drive gear 52 and the bracket 71 as viewed from the side of the side wall plate 70. FIG. 5 also illustrates a transmission sensor 51 including a light emitting portion 51*a* and a light receiving portion 51*b*, a sensor holder 55, a gear teeth surface 523, and a motor gear 531.

Figure 6B:
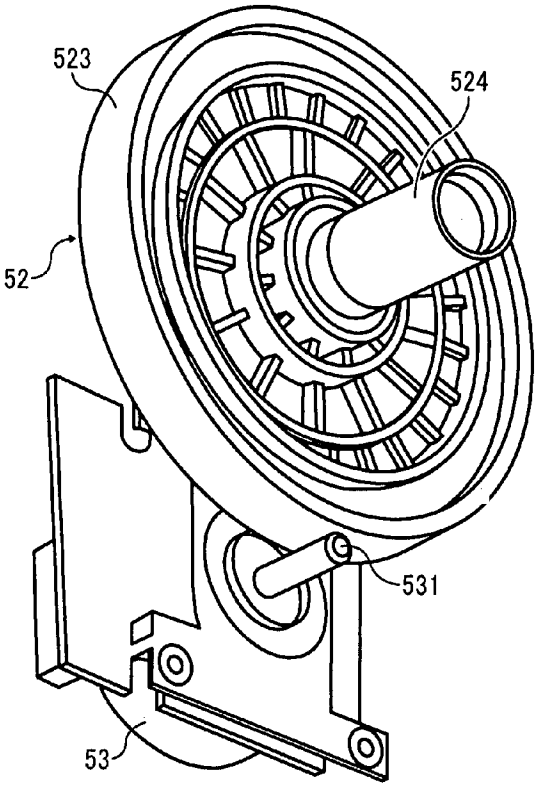
FIGS. 6A to 6C are explanatory views of a sensor unit, the photoconductor drive gear, and a drive motor of the drive device according to the embodiment of the present invention, FIG. 6A illustrating an explanatory perspective view of the components as viewed from the side of the bracket, FIG. 6B illustrating an explanatory perspective view of the components as viewed from the side of the side wall plate, and FIG. 6C illustrating an explanatory enlarged view of the sensor unit.
Figure 6A:
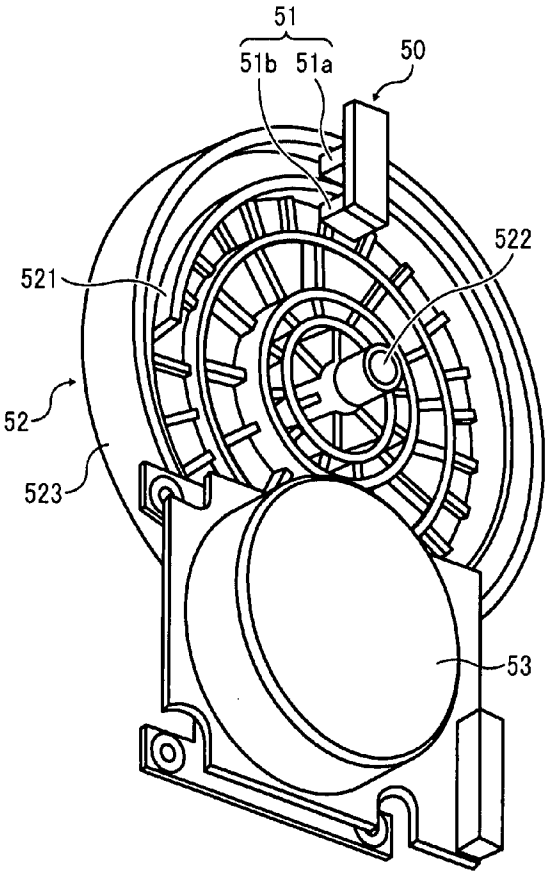
Figure 6C:
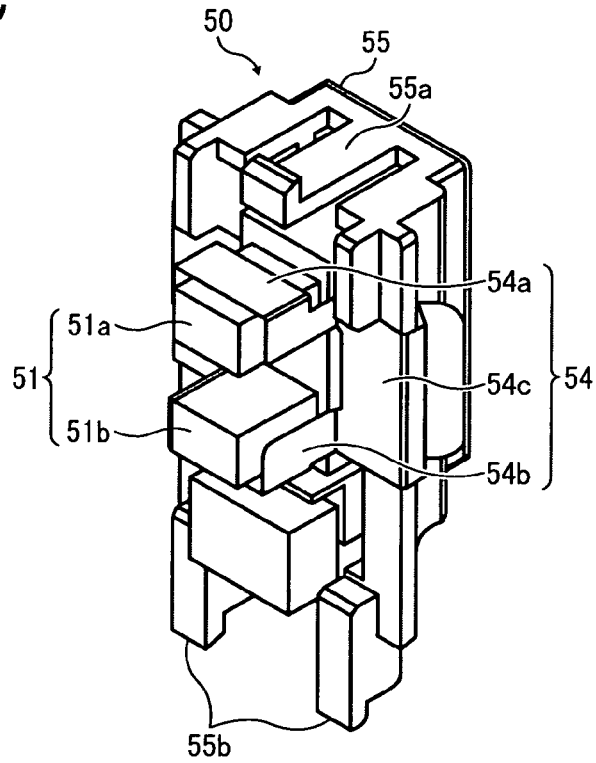

Further, FIGS. 6A to 6C are explanatory views of the sensor unit 50 including the transmission sensor 51, the photoconductor drive gear 52, and the drive motor 53, which are included in a drive device 500. FIG. 6A is an explanatory perspective view of the components, as viewed from the side of the bracket 71. FIG. 6B is an explanatory perspective view of the components, as viewed from the side of the side wall plate 70. A reference numeral "524" represents a joint portion. FIG. 6C is an explanatory enlarged view of the sensor unit 50. In FIG. 6C, the sensor cover 54 includes a light emitting portion protecting portion 54*a*, a light receiving portion protecting portion 54*b*, and a mounting portion 54*c*, and the sensor holder 55 includes a snap-fit portion 55*a* and hooks 55*b*.

In the drive device 500, the drive motor 53 serving as the drive source is driven to rotate the motor gear 531. As the motor gear 531 rotates, the drive power is transmitted to the photoconductor drive gear 52 meshing with the motor gear 531, thereby rotating the photoconductor drive gear 52. A rotary shaft of the photoconductor drum 11 is connected to the joint portion 524 provided to the photoconductor drive gear 52. Therefore, the photoconductor drum 11 rotates in accordance with the rotation of the photoconductor drive gear 52. In the present embodiment, the motor gear 531 and the photoconductor drive gear 52 form a drive transmission device.

A configuration for driving to rotate the photoconductor drums 11 includes a configuration in which drive devices are provided for the respective colors, as in the present embodiment, and a configuration that drives multiple photoconductor drums 11 by using a joint gear configuration. The present invention is applicable to both of these configurations, and is not limited by the configuration of the drive device.

Further, in the present embodiment, a configuration that transmits the rotational drive of the drive motor 53 to the photoconductor drum 11 is taken as an example of the drive transmission device. However, this is only an example, and the configuration to which the present invention is applicable is not limited to the configuration that transmits the drive power to the photoconductor. It is to be noted that the present invention is applicable to all configurations including a drive transmission gear train, a position detection member, and a detection unit.

As illustrated in FIGS. 3B and 6A, a surface of the photoconductor drive gear 52 facing the bracket 71 is provided with the feeler 521 serving as the position detection member. In the present embodiment, the feeler 521 serving as the position detection member is integrated with the photoconductor drive gear 52. Alternatively, the configuration may be modified such that the photoconductor drive gear 52 is provided with a position detection member formed separately from photoconductor drive gear 52.

In the printer 100, to detect the rotation cycle of each of the photoconductor drums 11, the transmission sensor 51 serving as the detection unit detects the feeler 521 at the detection position of the transmission sensor 51. In the state of FIG. 6A, the feeler 521 is present between the light emitting portion 51*a* and the light receiving portion 51*b*, and therefore the light emitted from the light emitting portion 51*a* is blocked by the feeler 521. With the light not received by the light receiving portion 51*b*, the transmission sensor 51 detects that the feeler 521 is present at the detection position of the transmission sensor 51, which is between the light emitting portion 51*a* and the light receiving portion 51*b*. By contrast, in the state of FIG. 3B, the feeler 521 is not present at the detection position of the transmission sensor 51.

In the printer 100, with the detection of the feeler 521 at the detection position of the transmission sensor 51, the rotation start position and the rotation cycle of the photoconductor drum 11 rotating together with the photoconductor drive gear 52 are detected. At the same time, a pattern is formed on the intermediate transfer belt 12. With this operation, the phases of cycle variations of the multiple photoconductor drums 11 are detected, and a control for matching the phases is performed. Accordingly, the accuracy of color registration is enhanced.

In the drive device 500 including the feeler 521 and the transmission sensor 51 for detecting the gear rotation cycle, the photoconductor drive gear 52 may be charged by sliding friction caused by meshing between the photoconductor drive gear 52 and the motor gear 531. Further, the photoconductor drive gear 52 may be charged to a relatively high potential and generate a relatively strong electric field in the vicinity thereof, depending on conditions such as the gear diameter of the photoconductor drive gear 52 and the drive load. Further, it is known that an increase in gear diameter results in a larger charge amount and a stronger electric field.

In the drive device 500 of the present embodiment, a gear having a relatively large diameter of approximately 100 mm is used as the photoconductor drive gear 52. The use of the large-diameter gear allows accurate control of the rotational position of the photoconductor drum 11.

After continuous driving of the drive device 500, the potential on the surface of the photoconductor drive gear 52 was measured. It was revealed from the measurement that a range of approximately 30 mm from the gear teeth surface 523, which is a source generating the charge potential of the photoconductor drive gear 52, was charged to a high potential that may cause dielectric breakdown in an electronic component disposed in the vicinity of the photoconductor drive gear 52. In the configuration according to the embodiment of the present invention, the detection unit (i.e., the transmission sensor 51 in the present embodiment) corresponds to the electronic component in which dielectric breakdown may be caused by the detection target gear charged to a relatively high potential (i.e., the photoconductor drive gear 52 in the present embodiment).

If the transmission sensor 51 is exposed for a long time to a relatively strong electric field generated by the charging of the photoconductor drive gear 52 to a relatively high potential, dielectric breakdown occurs and causes abnormal output from the transmission sensor 51. The drive motor 53 performs a control including an operation sequence using a time to detect the feeler 521 by the transmission sensor 51 as a trigger. If an abnormality arises in the output waveform of the transmission sensor 51, the drive motor 53 may fall into an uncontrollable state and cause an abnormal processing operation.

As a configuration for minimizing malfunction caused by discharge attributed to the strong electric field, a method has been proposed to minimize malfunction caused by Paschen discharge attributed to a strong electric field generated in a transfer unit. However, the discharge phenomenon that may be caused by the charging of a gear to a relatively high potential due to friction occurring between the gear and another gear has not been studied much.

Embodiment 1

In view of the above, a description is given of Embodiment 1 of the present invention, a configuration that minimizes the occurrence of dielectric breakdown between the photoconductor drive gear 52 and the transmission sensor 51.

In the drive device 500 of Embodiment 1, the sensor cover 54 is provided to minimize the occurrence of dielectric breakdown between the photoconductor drive gear 52 and the transmission sensor 51. As illustrated in FIG. 6C, the transmission sensor 51 is installed to the sensor holder 55. Further, the sensor cover 54 formed into a shape surrounding a peripheral portion of the transmission sensor 51 is installed to the sensor holder 55. The sensor cover 54 is made of a conductive material. As a specific example, in the present embodiment the sensor cover 54 is made of a sheet metal, a SUS (Steel Use Stainless) sheet metal, or the like. The sensor cover 54 is a unit integrating the light emitting portion protecting portion 54*a* for covering upper and side portions of the light emitting portion 51*a*, the light receiving portion protecting portion 54*b* for covering lower and side portions of the light receiving portion 51*b*, and the mounting portion 54*c* for assembling the sensor cover 54 to the sensor holder 55.

The sensor unit 50 is installed with the sensor holder 55 fit in an opening formed in the bracket 71. That is, in this configuration, hooks 55*b* at the lower end of the sensor holder 55 are inserted in the opening of the bracket 71, and a snap-fit portion 55*a* at the upper end of the sensor holder 55 fixes the sensor holder 55 to the bracket 71.

With the sensor holder 55 fit in the bracket 71 as described above, the mounting portion 54*c* of the sensor cover 54 contacts the bracket 71. The bracket 71 is electrically grounded. With the mounting portion 54*c* contacting with the bracket 71, the sensor cover 54 is electrically grounded stably.

With this configuration, if the photoconductor drive gear 52 is charged to a relatively high potential and causes the discharge phenomenon, discharged electric current flows into the sensor cover 54. Therefore, the occurrence of dielectric breakdown between the photoconductor drive gear 52 and the transmission sensor 51 can be reduced or minimized.

Further, the transmission sensor 51 is normally formed into a shape that protects a light emitting element of the light emitting portion 51*a* and a light receiving element of the light receiving portion 51*b* by using a resin cover. If a conductive member such as the sensor cover 54 is disposed in the vicinity of the transmission sensor 51, therefore, the electric current discharged by the discharge phenomenon flows into the conductive member with substantial ease. Therefore, in consideration of the interference between the sensor cover 54 and the photoconductor drive gear 52, a portion of the sensor cover 54 closest to the photoconductor drive gear 52 may be set away from a portion of the transmission sensor 51 closest to the photoconductor drive gear 52 by approximately a few millimeters.

The sensor cover 54 and the transmission sensor 51 are configured to be assembled to the sensor holder 55. With the sensor holder 55 fixed to the bracket 71, the sensor cover 54 and the transmission sensor 51 relative to the printer 100 are positioned.

Further, as illustrated in FIG. 6C, the light emitting portion protecting portion 54*a* and the light receiving portion protecting portion 54*b* of the sensor cover 54 are formed into a substantially U-shape to respectively surround the light emitting portion 51*a* and the light receiving portion 51*b* of the transmission sensor 51. With this shape, the installation range in the vertical and horizontal directions of the light emitting portion protecting portion 54*a* and the light receiving portion protecting portion 54*b* of the sensor cover 54 is regulated by the transmission sensor 51.

The portion of the sensor cover 54 closest to the photoconductor drive gear 52 is the light emitting portion protecting portion 54*a* or the light receiving portion protecting portion 54*b*.

Here, if the light emitting portion protecting portion 54*a* is located lower than in the state illustrated in FIG. 6C due to the manufacturing tolerance of the sensor cover 54, for example, the lower ends of the light emitting portion protecting portion 54*a* may contact the feeler 521 passing the detection position of the transmission sensor 51. In the present embodiment, however, even if there is a dimensional error in the sensor cover 54 causing the lower ends of the light emitting portion protecting portion 54*a* to contact the feeler 521, the lower surface of an upper portion of the light emitting portion protecting portion 54*a* abuts against the upper surface of the light emitting portion 51*a*, when the transmission sensor 51 and the sensor cover 54 are assembled to the sensor holder 55. Then, the shape of the shape-variable sensor cover 54 is corrected by the transmission sensor 51 such that the light emitting portion protecting portion 54*a*, which is the portion of the sensor cover 54 closest to the photoconductor drive gear 52, has the lower ends shifted in position relative to the transmission sensor 51 within a predetermined range, i.e., such that the position of the lower ends of the light emitting portion protecting portion 54*a* is within a range not contacting the feeler 521. By so doing, the lower ends of the light emitting portion protecting portion 54*a* are regulated in position and prevented from contacting the feeler 521 of the photoconductor drive gear 52.

Similarly, if the light receiving portion protecting portion 54*b* is located higher than in the state illustrated in FIG. 6C due to the manufacturing tolerance of the sensor cover 54, the upper surface of a lower portion of the light receiving portion protecting portion 54*b* abuts against the lower surface of the light receiving portion 51*b*, when the transmission sensor 51 and the sensor cover 54 are assembled to the sensor holder 55. Then, the shape of the shape-variable sensor cover 54 is corrected by the transmission sensor 51 such that the light receiving portion protecting portion 54*b*, which is the portion of the sensor cover 54 closest to the photoconductor drive gear 52, has the upper ends shifted in position relative to the transmission sensor 51 within a predetermined range, i.e., such that the position of the upper ends of the light receiving portion protecting portion 54*b* is within a range not contacting the feeler 521. By so doing, the upper ends of the light receiving portion protecting portion 54*b* are regulated in position and prevented from contacting the feeler 521 of the photoconductor drive gear 52.

With the upper surface of the light emitting portion 51*a* regulating the position of the light emitting portion protecting portion 54*a* and the lower surface of the light receiving portion 51*b* regulating the position of the light receiving portion protecting portion 54*b*, the light emitting portion protecting portion 54*a* and the light receiving portion protecting portion 54*b* of the sensor cover 54 are regulated in position in the vertical direction.

Further, if the light receiving portion protecting portion 54*b* or the light emitting portion protecting portion 54*a* is shifted in position in the horizontal direction from the position illustrated in FIG. 6C due to the manufacturing tolerance of the sensor cover 54, the circular arc-shaped feeler 521 may contact one of the upper ends of the light receiving portion protecting portion 54*b*, or the light emitting portion protecting portion 54*a* may contact the inner rim of the outer circumference of the photoconductor drive gear 52. By contrast, in the present embodiment, even if there is a dimensional error in the sensor cover 54 causing the light receiving portion protecting portion 54*b* or the light emitting portion protecting portion 54*a* to contact a part of the photoconductor drive gear 52, the inner surface of a side wall portion of the light receiving portion protecting portion 54*b* or the light emitting portion protecting portion 54*a* abuts against a side surface of the light receiving portion 51*b* or the light emitting portion 51*a*, when the transmission sensor 51 and the sensor cover 54 are assembled to the sensor holder 55. Then, the shape of the shape-variable sensor cover 54 is corrected by the transmission sensor 51 such that the light receiving portion protecting portion 54*b* or the light emitting portion protecting portion 54*a*, which is the portion of the sensor cover 54 closest to the photoconductor drive gear 52, is shifted in position relative to the transmission sensor 51 within a predetermined range, i.e., such that the light receiving portion protecting portion 54*b* or the light emitting portion protecting portion 54*a* is within a range not contacting with the photoconductor drive gear 52.

By so doing, the light receiving portion protecting portion 54*b* or the light emitting portion protecting portion 54*a* is regulated in position in the horizontal direction and prevented from contacting the photoconductor drive gear 52.

With the side surfaces of the light receiving portion 51*b* and the light emitting portion 51*a* regulating the positions of the side wall portions of the light receiving portion protecting portion 54*b* and the light emitting portion protecting portion 54*a*, the light emitting portion protecting portion 54*a* and the light receiving portion protecting portion 54*b* of the sensor cover 54 are regulated in position in the horizontal position.

Accordingly, the present embodiment is configured such that the light emitting portion protecting portion 54*a* and the light receiving portion protecting portion 54*b* of the sensor cover 54 are regulated in position in two directions, which are vertical and horizontal directions, by and relative to the transmission sensor 51.

With this configuration, the sensor cover 54 is regulated in position, with no use of other components, by and relative to the transmission sensor 51 disposed in the vicinity of the feeler 521 of the photoconductor drive gear 52. Therefore, variations in assembling accuracy of components are substantially minimized. Further, it is possible, in the assembling process, to set the sensor cover 54 relative to the transmission sensor 51 so as not to be excessively close to the photoconductor drive gear 52, simply by adjusting the sizes of two components.

Figure 7:
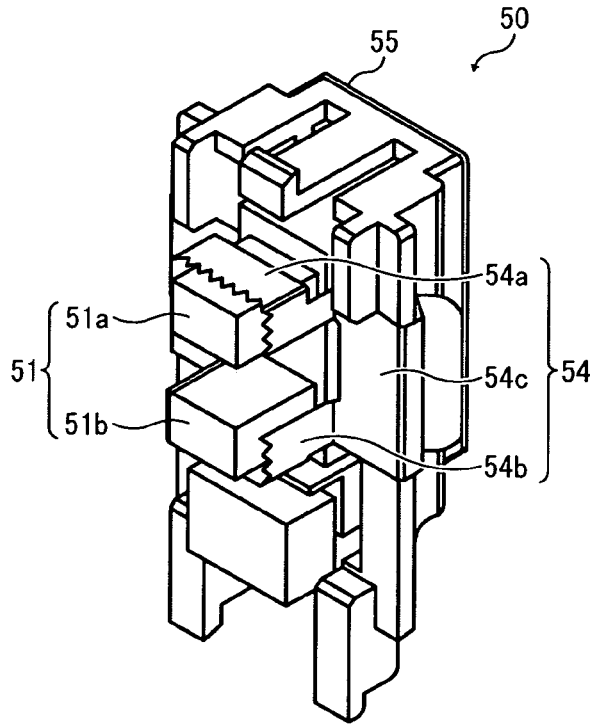
FIG. 7 is a perspective view of the sensor unit configured to include a sensor cover having serrated edges.

Further, as illustrated in FIG. 6C, in the sensor cover 54 of Embodiment 1, portions of the sensor cover 54 close to the photoconductor drive gear 52 have a linear outer shape. The shape of the portions of the sensor cover 54 close to the photoconductor drive gear 52 may be changed into a shape facilitating the flow of electric current. Such a change in shape is expected to enhance the effect of reducing or minimizing the electric current flow into the transmission sensor 51 caused by the discharge phenomenon. As an example of the shape of the portions of the sensor cover 54 close to the photoconductor drive gear 52 facilitating the flow of current, edges of the light emitting portion protecting portion 54*a* and the light receiving portion protecting portion 54*b* of the sensor cover 54 may be formed into a serrated shape, as illustrated in FIG. 7.

Further, in Embodiment 1, a thin sheet metal is assumed as the conductive material forming the sensor cover 54. Similar effects to the effects of the thin sheet metal can also be obtained by a conductive tape, which is typified by a copper foil tape, protecting the periphery of the transmission sensor 51. In the case of using the sensor cover 54 formed by a conductive tape, if the conductive tape is extended from the transmission sensor 51 to the position at which the sensor holder 55 contacts the bracket 71, the electric grounding of the sensor cover 54 is ensured.

Embodiment 2

Subsequently, a description is given of Embodiment 2 of the present invention, the configuration that minimizes the occurrence of dielectric breakdown between the photoconductor drive gear 52 and the transmission sensor 51, with reference to FIG. 8.

Figure 8:
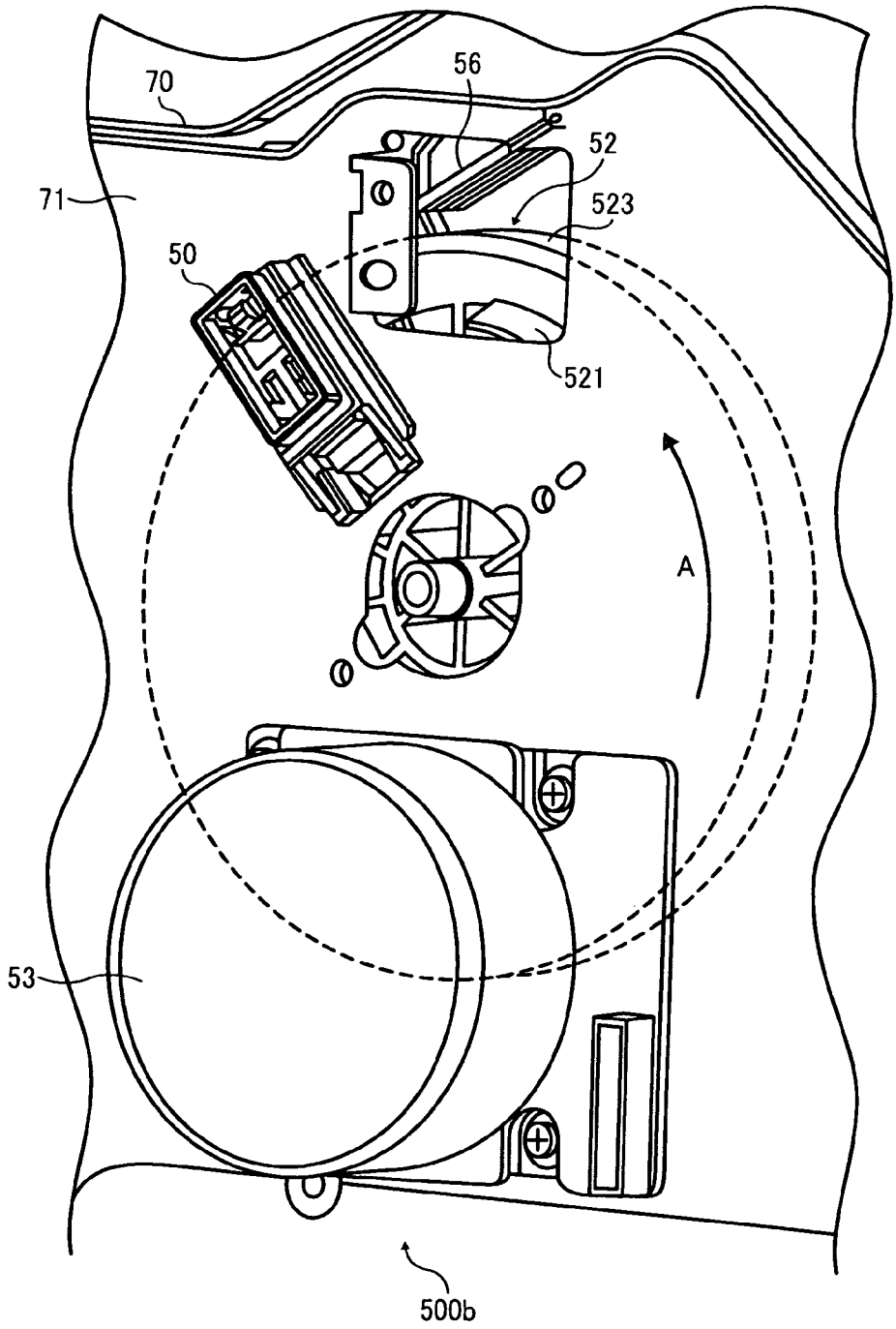
FIG. 8 is a perspective view of a drive device according to a second embodiment of the present invention.

FIG. 8 is a perspective view of a drive device 500*b* of Embodiment 2, as viewed from the side of the bracket 71. In the drive device 500*b* of the present embodiment, the photoconductor drive gear 52 may be charged by sliding friction caused by the meshing between the photoconductor drive gear 52 and the motor gear 531, and a region in the vicinity of the photoconductor drive gear 52 may be charged to a relatively strong electric field, as described above. Further, in the drive device 500*b*, the rotation start position and the rotation cycle of the photoconductor drum 11 are detected based on the detection of the time at which the feeler 521 attached to the photoconductor drive gear 52 passes the detection position of the transmission sensor 51 provided in the sensor unit 50.

In the photoconductor drive gear 52, the gear teeth surface 523 acts as a charge source due to the sliding friction caused by the meshing between the photoconductor drive gear 52 and the motor gear 531. In Embodiment 2, therefore, a discharge brush 56 serving as a charge prevention member is provided in the vicinity of the gear teeth surface 523. By so doing, the potential of the gear teeth surface 523 charged by the sliding friction is removed. Accordingly, the photoconductor drive gear 52 is prevented from being charged to a high potential, and the generation of a strong electric field is prevented.

With the above-described charge prevention member, the potential of the photoconductor drive gear 52 is substantially reduced, although the potential may not be completely removed. Consequently, the photoconductor drive gear 52 is prevented from being charged to a high potential, and a strong electric field is not generated. Accordingly, the occurrence of dielectric breakdown between the photoconductor drive gear 52 and the transmission sensor 51 is reduced or minimized. Further, the reduction of the occurrence of dielectric breakdown results in prevention of damage to the transmission sensor 51.

An experiment was carried out to compare the potential of the gear teeth surface 523 of the photoconductor drive gear 52 in the presence of the discharge brush 56 with the potential of the gear teeth surface 523 in the absence of the discharge brush 56. The experiment revealed a substantial difference in surface potential of the gear teeth surface 523.

Further, the discharge brush 56 and the gear teeth surface 523 may contact with each other. However, it is desirable that the discharge brush 56 and the gear teeth surface 523 are spaced from each other by a distance of approximately 1 mm to approximately 2 min at the position at which the discharge brush 56 and the gear teeth surface 523 are closest to each other. If the discharge brush 56 is not in contact with the gear teeth surface 523 but is spaced therefrom by a slight distance, the discharge effect is increased, and bristles of the discharge brush 56 are prevented from being removed by the contact between the discharge brush 56 and the gear teeth surface 523.

In FIG. 8, the discharge brush 56 is disposed upstream from the installation position of the sensor unit 50 in the rotation direction of the photoconductor drive gear 52, i.e., the direction indicated by arrow A in FIG. 8. In consideration of prevention of the occurrence of dielectric breakdown between the photoconductor drive gear 52 and the transmission sensor 51, it is desirable to reduce the potential at a position of the photoconductor drive gear 52 in the vicinity of and immediately before the transmission sensor 51. With the discharge brush 56 disposed upstream from the installation position of the sensor unit 50 in the rotation direction of the photoconductor drive gear 52, the occurrence of dielectric breakdown between the photoconductor drive gear 52 and the transmission sensor 51 is more reliably reduced or minimized.

The configuration of Embodiment 2 in which the discharge brush 56 is disposed in the vicinity of the gear teeth surface 523, however, minimizes an increase in potential on the gear teeth surface 523 acting as the charge source. Therefore, the occurrence of dielectric breakdown is substantially reduced or minimized, even if the installation position of the discharge brush 56 is not upstream from the installation position of the sensor unit 50 in the rotation direction of the photoconductor drive gear 52. Thus, Embodiment 2 minimizes the increase in potential at the charge source. Therefore, the installation position of the discharge brush 56 is not limited by the relationship thereof with the installation position of the sensor unit 50.

Further, if the discharge brush 56 of Embodiment 2 is provided in the drive device 500 of Embodiment 1 including the sensor cover 54, the occurrence of dielectric breakdown is more reliably reduced or minimized.

Embodiment 3

Subsequently, a description is given of Embodiment 3 of the present invention, the configuration that minimizes the occurrence of dielectric breakdown between the photoconductor drive gear 52 and the transmission sensor 51, with reference to FIG. 9.

Figure 9:
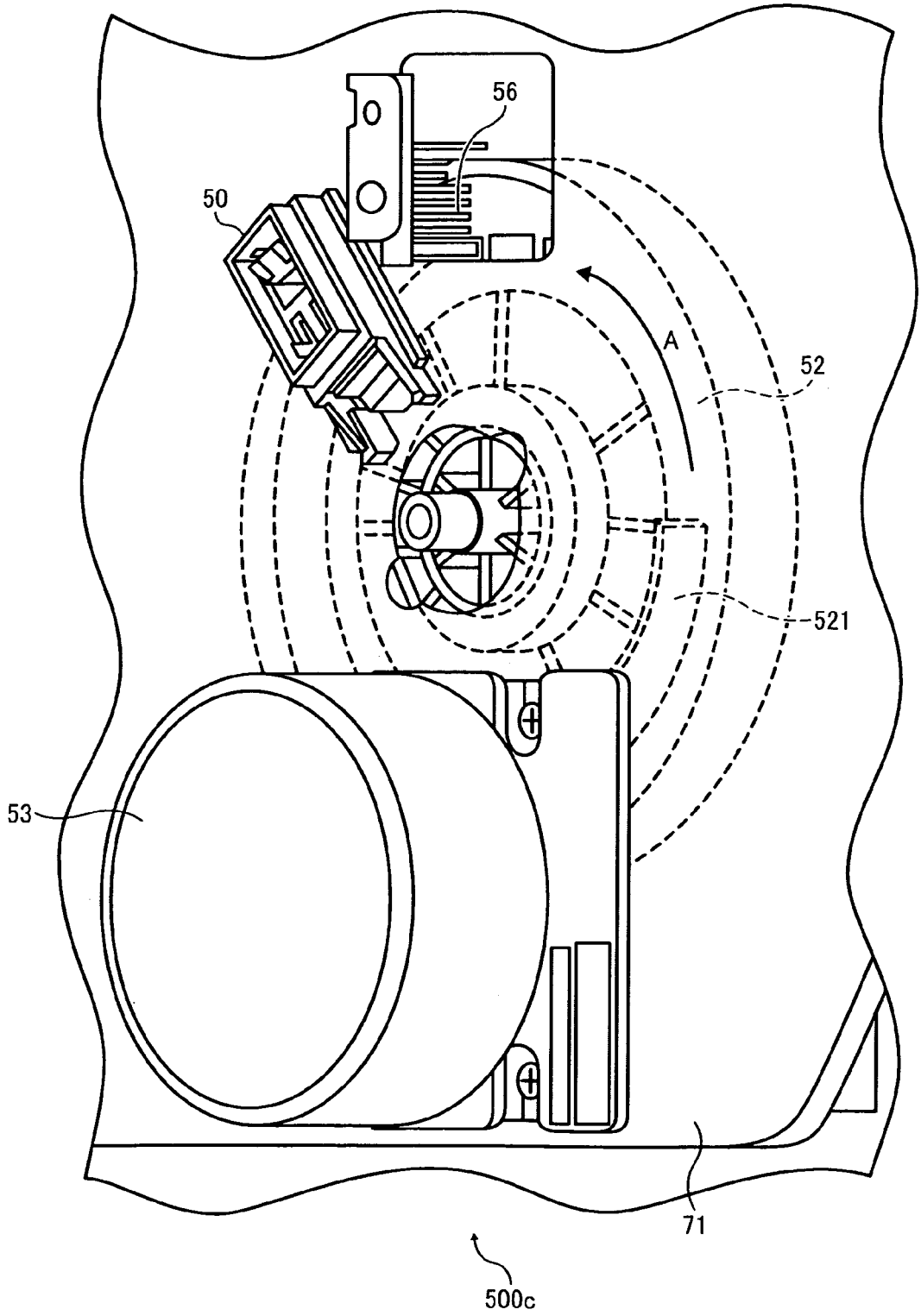
FIG. 9 is a perspective view of a drive device according to a third embodiment of the present invention.

FIG. 9 is a perspective view of a drive device 500*c* of Embodiment 3, as viewed from the side of the bracket 71. In the drive device 500*c* of the present embodiment, the photoconductor drive gear 52 may be charged by sliding friction caused by the meshing between the photoconductor drive gear 52 and the motor gear 531, and a region in the vicinity of the photoconductor drive gear 52 may be charged to a relatively strong electric field, as described above. Further, in the drive device 500*c*, the rotation start position and the rotation cycle of the photoconductor drum 11 are detected based on the detection of the time at which the feeler 521 attached to the photoconductor drive gear 52 passes the detection position of the transmission sensor 51 provided in the sensor unit 50.

In the above-described drive device 500*c*, when the feeler 521 passes the detection position of the transmission sensor 51, which is between the light emitting portion 51*a* and the light receiving portion 51*b*, the photoconductor drive gear 52, which is a member charged to a relatively high potential, and the transmission sensor 51 are closest to each other. Therefore, it is highly possible that the discharge phenomenon is caused by a relatively strong electric field, when the feeler 521 passes the position between the light emitting portion 51*a* and the light receiving portion 51*b* of the transmission sensor 51.

In Embodiment 3, therefore, the discharge brush 56 is provided in the vicinity of the position where the rotating feeler 521, which is provided to a gear side surface portion of the photoconductor drive gear 52, passes. Further, as for the installation position of the discharge brush 56, it is desirable to dispose the discharge brush 56 at a position immediately before the detection position of the transmission sensor 51 passed by the feeler 521, in consideration of the rotation direction of the photoconductor drive gear 52, i.e., the direction indicated by arrow A in FIG. 9. The removal of the charge generated by the gear rotation immediately before the feeler 521 passes the detection position can thereby substantially reduce the charge amount of the feeler 521 passing the detection position.

It was confirmed from an experiment that the discharge brush 56 disposed in the vicinity of the position passed by the feeler 521 successfully reduces the surface potential of the feeler 521.

In Embodiment 3, the photoconductor drive gear 52 rotates in the direction indicated by arrow A in FIG. 9, and the installation position of the discharge brush 56 is upstream from the installation position of the sensor unit 50 in the rotation direction of the photoconductor drive gear 52. With this configuration, the gear side surface of the photoconductor drive gear 52 is discharged immediately before the photoconductor drive gear 52 passes the position at which the photoconductor drive gear 52 is closest to the transmission sensor 51.

The discharge brush 56 and the gear side surface of the photoconductor drive gear 52 may be in contact with each other. However, similarly to Embodiment 2, it is desirable that the discharge brush 56 and the gear side surface are spaced from each other by a distance of approximately 1 mm to approximately 2 mm at the position at which the discharge brush 56 and the gear side surface are closest to each other.

Further, if the discharge brush 56 of Embodiment 3 is provided in the drive device 500 of Embodiment 1 including the sensor cover 54, the occurrence of dielectric breakdown is more reliably reduced or minimized.

In the photoconductor drive gear 52 of the drive device 500*c*, the gear teeth surface 523 acts as a charge source. Therefore, the surface potential is the highest in the gear outer circumferential portion of the photoconductor drive gear 52, and is reduced toward the rotary shaft 522 of the photoconductor drive gear 52. As the photoconductor drive gear 52 of the present embodiment, a gear having a relatively large diameter of approximately 100 mm is used. At a position away from the gear teeth surface 523 toward the rotary shaft 522 by approximately 30 mm, the surface potential of the photoconductor drive gear 52 was reduced to half the surface potential of the gear teeth surface 523. At such a position, the occurrence of dielectric breakdown attributed to the charging of the photoconductor drive gear 52 to a relatively high potential can be reduced. Therefore, it is desirable to set the installation position of the feeler 521 in the photoconductor drive gear 52 to a position away from the gear teeth surface 523 toward the center of rotation of the photoconductor drive gear 52 by at least approximately 30 mm.

As described above, in the drive transmission device forming each of the drive devices 500, 500*b*, and 500*c* of the present embodiments, the drive transmission members for transmitting drive from the drive motor 53 serving as the drive source to the photoconductor drum 11 serving as the driven object. The drive transmission members including or formed by the gear train include the motor gear 531 and the photoconductor drive gear 52. Further, the drive transmission device includes the detection device for detecting the rotational position of the photoconductor drive gear 52 forming the gear train and serving as the detection target gear. The detection device includes the feeler 521 and the transmission sensor 51. The feeler 521 serves as the position detection member that is provided to the photoconductor drive gear 52, and the position of which changes in accordance with the change in rotational position of the photoconductor drive gear 52. The transmission sensor 51 serves as the detection unit disposed in the vicinity of the photoconductor drive gear 52 to detect the feeler 521 at the detection position. The thus-configured drive transmission device includes the sensor cover 54, which serves as the shape-variable protection member protecting a region near the outer circumferential portion of the transmission sensor 51 and made of a conductive material minimizing the influence of electromagnetic waves on the transmission sensor 51.

With the sensor cover 54, the drive transmission device can reduce or minimize the occurrence of dialectic breakdown between the photoconductor drive gear 52 and the transmission sensor 51, even if the photoconductor drive gear 52 is charged to a relatively high potential by frictional charge generated between the photoconductor drive gear 52 and the motor gear 531. This is because electric current leakage occurs between the photoconductor drive gear 52 and the transmission sensor 51 before the dialectic breakdown occurs therebetween. Therefore, even if the transmission sensor 51 is disposed in the vicinity of the photoconductor drive gear 52, abnormal output from the transmission sensor 51 and damage to the transmission sensor 51 attributed to the dielectric breakdown can be reduced or minimized.

Further, as illustrated in FIG. 6C, the transmission sensor 51 serving as the detection unit and the sensor cover 54 serving as the protection member are assembled to the same member, i.e., the sensor holder 55 for installation to the side wall plate 70 and the bracket 71 forming the printer 100.

This configuration substantially minimizes variations of the sensor cover 54, which is the protection member disposed in the vicinity of a rotary member such as the photoconductor drive gear 52, relative to the transmission sensor 51 serving as the detection unit.

Further, as illustrated in FIG. 6C, the light emitting portion protecting portion 54*a* and the light receiving portion protecting portion 54*b*, each of which is the portion of the sensor cover 54 closest to the photoconductor drive gear 52, are regulated in the range of the installation positions thereof in the vertical and horizontal directions by the transmission sensor 51 serving as the detection unit. When the sensor cover 54 is disposed in the vicinity of the transmission sensor 51, the installation positions of the light emitting portion protecting portion 54*a* and the light receiving portion protecting portion 54*b* of the sensor cover 54 are regulated by the use of the transmission sensor 51.

With the above-described regulation, the light emitting portion protecting portion 54*a* and the light receiving portion protecting portion 54*b* of the sensor cover 54 are regulated in position, with no use of other components. Accordingly, variations in the installation positions of the light emitting portion protecting portion 54*a* and the light receiving portion protecting portion 54*b* of the sensor cover 54 relative to the transmission sensor 51 can be substantially reduced or minimized. Consequently, the sensor cover 54 is appropriately positioned in the vicinity of the photoconductor drive gear 52.

Further, as illustrated in FIG. 6C, Embodiment 1 is configured to install the sensor cover 54 and the transmission sensor 51 to the same member, i.e., the sensor holder 55, as a method of positioning the light emitting portion protecting portion 54*a* and the light receiving portion protecting portion 54*b* of the sensor cover 54 with respect to the transmission sensor 51. Further, the embodiment is configured to use the shape of the transmission sensor 51, which includes the upper surface of the light emitting portion 51*a*, the lower surface of the light receiving portion 51*b*, and the side surfaces of the light emitting portion 51*a* and the light receiving portion 51*b*, to regulate the installation range of the light emitting portion protecting portion 54*a* and the light receiving portion protecting portion 54*b* of the sensor cover 54 in two directions of vertical and horizontal directions.

With this configuration, variations in the assembling of the sensor cover 54 and the transmission sensor 51 can be substantially reduced or minimized.

Further, in the drive transmission device of Embodiment 1, the sensor cover 54 serving as the protection member is made of a sheet metal to minimize the influence of electromagnetic waves on the transmission sensor 51. Further, the sensor cover 54 is electrically grounded with the mounting portion 54*c* coming into contact with the grounded bracket 71.

With this configuration, if the photoconductor drive gear 52 is charged to a relatively high potential and causes the discharge phenomenon, the discharged electric current can easily flow into the sensor cover 54. Consequently, electric current flow into the transmission sensor 51 can be more reliably reduced or minimized.

Further, the sensor cover 54 serving as the protection member may include a conductive tape covering the transmission sensor 51 to minimize the influence of electromagnetic waves on the transmission sensor 51. Further, a part of the sensor cover 54 formed by the conductive tape may be electrically grounded.

With this configuration, if the photoconductor drive gear 52 is charged to a relatively high potential and causes the discharge phenomenon, the discharged electric current can easily flow into the sensor cover 54, and electric current flow into the transmission sensor 51 can be more reliably reduced or minimized, similarly as in Embodiment 1.

Further, the drive transmission device forming the drive device 500*b* of Embodiment 2 includes, in the vicinity of the photoconductor drive gear 52 serving as the detection target gear, the discharge brush 56 serving as the charge prevention member for preventing an increase in charge potential of the photoconductor drive gear 52.

This configuration can minimize the generation of a relatively strong electric field in the vicinity of the photoconductor drive gear 52 provided with the transmission sensor 51, the occurrence of dielectric breakdown between the photoconductor drive gear 52 and the transmission sensor 51, and abnormal output from the transmission sensor 51 and damage to the transmission sensor 51 attributed to the dielectric breakdown.

Further, in Embodiment 1, the discharge brush 56 including a brush having a charge neutralization capability serves as the charge prevention member.

Accordingly, a configuration preventing an increase in charge potential of the photoconductor drive gear 52 can be attained.

Further, in Embodiment 2, the discharge brush 56 is provided in the vicinity of the gear teeth surface 523 of the photoconductor drive gear 52, as illustrated in FIG. 8.

The discharge brush 56 for removing the potential of the photoconductor drive gear 52 is disposed in the vicinity of the gear teeth surface 523, which is charged by sliding friction when the photoconductor drive gear 52 is charged to a relatively high potential. With this configuration, an increase in charge amount of the photoconductor drive gear 52 can be reduced or minimized. By so doing, the charging of the photoconductor drive gear 52 to a relatively high potential can be reduced or minimized. Consequently, the configuration minimizes the generation of a relatively strong electric field in the vicinity of the photoconductor drive gear 52, the occurrence of dielectric breakdown between the photoconductor drive gear 52 and the transmission sensor 51, and abnormal output from the transmission sensor 51 and damage to the transmission sensor 51 attributed to the dielectric breakdown.

Further, in the drive transmission device forming the drive device 500*c* of Embodiment 3, the discharge brush 56 serving as the charge prevention member is provided in the vicinity of the position passed by the feeler 521 provided to the photoconductor drive gear 52 during the rotation of the photoconductor drive gear 52.

With the discharge brush 56 disposed in the vicinity of the position passed by the feeler 521, if the photoconductor drive gear 52 is charged to a relatively high potential by frictional charge generated between the photoconductor drive gear 52 and the motor gear 531, the potential of the photoconductor drive gear 52 can be reduced at least in the vicinity of the feeler 521. Consequently, a region near the portion of the photoconductor drive gear 52 closest to the transmission sensor 51, i.e., a region near the feeler 521 can be prevented from being charged to a relatively high potential. Therefore, even if a relatively strong electric field is generated in the vicinity of the photoconductor drive gear 52, the influence of the electric field can be minimized in the vicinity of the transmission sensor 51. Accordingly, the occurrence of dielectric breakdown between the photoconductor drive gear 52 and the transmission sensor 51 can be reduced, and abnormal output from the transmission sensor 51 and damage on the transmission sensor 51 attributed to the dielectric breakdown can be reduced or minimized.

Further, in the drive transmission device of Embodiment 3, the position at which the discharge brush 56 is closest to the photoconductor drive gear 52 is in the vicinity of the detection position of the transmission sensor 51 and upstream from the detection position in the rotation direction of the photoconductor drive gear 52.

With this configuration, the discharge by the discharge brush 56 can be performed immediately before the feeler 521 passes the detection position of the transmission sensor 51 that detects the feeler 521. Accordingly, the discharge for minimizing the occurrence of dielectric breakdown can be performed effectively.

Further, the feeler 521 serving as the position detection member may be disposed at a position closer to the center of rotation of the photoconductor drive gear 52 than the position away from the gear teeth surface 523 toward the center of rotation by approximately 30 mm, at which the surface potential of the charged photoconductor drive gear 52 is half the surface potential of the gear teeth surface 523.

With the feeler 521 disposed as described above, the occurrence of dielectric breakdown attributed to the charging of the photoconductor drive gear 52 to a relatively high potential can be reduced or minimized.

Further, each of the drive devices 500, 500*b*, and 500*c* of Embodiments 1, 2, and 3 includes the drive motor 53 serving as the drive source to drive rotatably, and the drive transmission device for transmitting the rotational drive of the drive motor 53 to the photoconductor drum 11 serving as the driven object. The drive transmission device includes, for example, the motor gear 531, the photoconductor drive gear 52, and the transmission sensor 51 described in these embodiments.

With this configuration, abnormality in the result of detection by the transmission sensor 51 attributed to the charging of the photoconductor drive gear 52 to a relatively high potential can be reduced or minimized. In a configuration that controls the driving of the drive motor 53 based on the result of detection by the transmission sensor 51, therefore, the driving of the drive motor 53 can be appropriately controlled.

Further, the printer 100 of Embodiments 1, 2, and 3 is an image forming apparatus including the printer unit 150 and the drive devices 500, 500*b*, and 500*c*. The printer unit 150 is the image forming unit that forms an image on the photoconductor drum 11 serving as the image carrying member and eventually transfers the image onto the recording sheet P serving as the recording medium to form the image on the recording sheet P. The drive device (any of the drive devices 500, 500*b*, and 500*c*) drives the photoconductor drum 11 serving as the driven object provided in the printer 100.

With one of the drive devices 500, 500*b*, and 500*c* of Embodiments 1, 2, and 3 used as the drive device of the printer 100, the driving of the drive motor 53 can be appropriately controlled, and the photoconductor drum 11 serving as the driven object can be appropriately driven to rotate. Further, by rotating the photoconductor drums 11 corresponding to four colors appropriately, as in the printer 100, a color registration error on the recording sheet P can be reduced or minimized, and high-quality image formation can be performed.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A drive transmission device, comprising:

drive transmission members to transmit drive from a drive source to a driven object, at least a part of the drive transmission members formed by a gear train including a detection target gear;

a detection device to detect the rotational position of the detection target gear, the detection device including a position detection member provided to the detection target gear, and configured to change in position in accordance with the change in rotational position of the detection target gear, and a detection unit disposed in the vicinity of the detection target gear, and configured to detect the position detection member at a detection position, the detection unit including a first detection member and a second detection member disposed facing each other, each of the first detection member and second detection member including a facing surface, an opposite surface, and side surfaces; and a shape-variable protection member made of a conductive material and including a first portion disposed in contact with the opposite surface and the side surfaces of the first detection member and a second portion disposed in contact with the opposite surface and the side surfaces of the second detection member, the shape-variable protection member being disposed free from the respective facing surfaces of the first detection member and the second detection.

2. The drive transmission device according to claim 1, wherein the protection member is made of a sheet metal, and a part of the protection member is electrically grounded.

3. The drive transmission device according to claim 1, wherein the protection member includes a conductive tape covering the detection unit, and a part of the protection member is electrically grounded.

4. The drive transmission device according to claim 1, further comprising:

a charge prevention member provided in the vicinity of the detection target gear, and configured to prevent an increase in charge potential of the detection target gear.

5. The drive transmission device according to claim 4, wherein the charge prevention member includes a brush having a charge neutralization capability.

6. The drive transmission device according to claim 4, wherein the charge prevention member is provided in the vicinity of a gear teeth surface of the detection target gear.

7. The drive transmission device according to claim 4, wherein the charge prevention member is provided in the vicinity of a position passed by the position detection member provided to the detection target gear during the rotation of the detection target gear.

8. The drive transmission device according to claim 4, wherein the position at which the charge prevention member is closest to the detection target gear is in the vicinity of the detection position, and is upstream from the detection position in the rotation direction of the detection target gear.

9. The drive transmission device according to claim 1, wherein the position detection member is disposed at a position closer to the center of rotation of the detection target gear than a position at which the surface potential of the charged detection target gear is half the surface potential of a gear teeth surface of the detection target gear.

10. A drive device, comprising:

a drive source to drive rotatably; and a drive transmission device according to claim 1 to transmit rotational drive of the drive source to the driven object.

11. An image forming apparatus, comprising:

an image forming unit to form an image on an image carrying member and eventually transfer the image onto a recording medium to form the image on the recording medium; and a drive device according to claim 10 to drive the driven object provided in the image forming apparatus.

12. The drive transmission device according to claim 1, wherein the shape-variable protection member further comprises a third portion to link the first portion to the second portion.

13. A drive device, comprising:

a drive source to drive rotatably; and a drive transmission device according to claim 12 to transmit rotational drive of the drive source to the driven object.

14. An image forming apparatus, comprising:

an image forming unit to form an image on an image carrying member and eventually transfer the image onto a recording medium to form the image on the recording medium; and a drive device according to claim 13 to drive the driven object provided in the image forming apparatus.

15. The drive transmission device according to claim 12, wherein at least the third portion of the shape-variable protection member is made of a sheet metal.

16. The drive transmission device according to claim 12, wherein at least the third portion of the shape-variable protection member is made of a conductive tape.

17. A drive device, comprising:

a drive source to drive rotatably; and a drive transmission device according to claim 15 to transmit rotational drive of the drive source to the driven object.

18. An image forming apparatus, comprising:

an image forming unit to form an image on an image carrying member and eventually transfer the image onto a recording medium to form the image on the recording medium; and a drive device according to claim 17 to drive the driven object provided in the image forming apparatus.

19. A drive device, comprising:

a drive source to drive rotatably; and a drive transmission device according to claim 16 to transmit rotational drive of the drive source to the driven object.

20. An image forming apparatus, comprising:

an image forming unit to form an image on an image carrying member and eventually transfer the image onto a recording medium to form the image on the recording medium; and a drive device according to claim 19 to drive the driven object provided in the image forming apparatus.

* * * * *